US008631523B1

(12) United States Patent
Schneider et al.

(10) Patent No.: US 8,631,523 B1
(45) Date of Patent: Jan. 21, 2014

(54) BACK-SCRATCHING AND WASHING DEVICE FOR USE IN A SHOWER

(76) Inventors: Kyle Schneider, Cecil, WI (US); John Schneider, Cecil, WI (US)

( * ) Notice: Subject to any disclaimer, the term of this patent is extended or adjusted under 35 U.S.C. 154(b) by 731 days.

(21) Appl. No.: 12/852,497

(22) Filed: Aug. 8, 2010

(51) Int. Cl.
*A47K 7/02* (2006.01)

(52) U.S. Cl.
USPC ..... 4/606

(58) Field of Classification Search
USPC ..... 4/606–608
See application file for complete search history.

(56) References Cited

U.S. PATENT DOCUMENTS

| | | | | |
|---|---|---|---|---|
| 2,664,585 | A * | 1/1954 | Gaither | 15/265 |
| 3,289,215 | A * | 12/1966 | Kennedy | 4/606 |
| 3,612,044 | A | 10/1971 | Gurrola | |
| 3,862,459 | A * | 1/1975 | Brunette | 15/88.3 |
| 4,040,132 | A * | 8/1977 | Braun | 4/606 |
| 4,047,259 | A * | 9/1977 | Lotis | 15/104.92 |
| 4,696,068 | A * | 9/1987 | Kenner | 4/606 |
| 4,704,756 | A * | 11/1987 | Williams et al. | 15/21.1 |
| 4,704,759 | A * | 11/1987 | Mesa | 15/160 |
| 5,175,896 | A * | 1/1993 | Zamir | 4/606 |
| 5,628,083 | A * | 5/1997 | Hayes | 15/244.3 |
| D400,658 | S * | 11/1998 | Mejia, Sr. | D23/304 |
| 5,996,163 | A * | 12/1999 | Galizia | 15/160 |
| 6,110,132 | A * | 8/2000 | Kurpieski | 601/136 |
| 6,370,722 | B1 * | 4/2002 | Duckworth | 15/104.92 |
| 6,427,279 | B1 * | 8/2002 | White et al. | 15/104.92 |
| 6,526,618 | B1 * | 3/2003 | Bolton | 15/160 |
| 6,647,564 | B1 * | 11/2003 | Smith | 4/606 |
| 6,832,688 | B1 * | 12/2004 | Rivera et al. | 206/581 |
| 6,996,861 | B1 * | 2/2006 | Clark, Jr. | 4/606 |
| 7,062,815 | B1 * | 6/2006 | Richardson | 15/21.1 |
| 7,120,947 | B1 * | 10/2006 | Magallanes | 4/606 |
| 7,155,769 | B1 * | 1/2007 | Baker | 15/104.92 |
| 7,266,857 | B1 * | 9/2007 | Mezyed | 15/104.92 |
| 7,434,287 | B1 * | 10/2008 | Borges | 15/104.92 |
| 7,757,338 | B2 * | 7/2010 | Rossiter et al. | 15/258 |
| 7,967,521 | B2 * | 6/2011 | Schiavo | 401/188 R |
| 2001/0039676 | A1 * | 11/2001 | McDowell | 4/606 |
| 2003/0167565 | A1 * | 9/2003 | Yoshida | 4/606 |
| 2005/0229347 | A1 * | 10/2005 | Dent D'Almuano | 15/160 |
| 2006/0107473 | A1 * | 5/2006 | Torres | 15/21.1 |
| 2009/0113616 | A1 * | 5/2009 | Daly, Sr. | 4/606 |
| 2009/0293189 | A1 * | 12/2009 | Somerville | 4/597 |
| 2011/0232137 | A1 * | 9/2011 | Desiderio et al. | 36/72 B |

* cited by examiner

*Primary Examiner* — Lori Baker

(57) ABSTRACT

The back-scratching and washing device for use in a shower includes a base that attaches to a smooth surface for use within a shower and features a plurality of interchangeable parts that attach to the base to perform a plurality of uniquely different skin engaging services. The interchangeable parts comprise rubber nodules, Loofahs, spring-loaded scrubbers, and bristled nodules. All of the interchangeable parts attach to the base via a spring pin located on a back of said part that engages one of an array of holes located on a front of said base. The device can be used to engage any part of a body, but is chiefly used for the back and hard to reach areas of said body. An array of suction cups located on a back of the base ensure secure attachment of the device to a smooth surface during engagement by an end user.

9 Claims, 5 Drawing Sheets

BACK-SCRATCHING AND WASHING DEVICE FOR USE IN A SHOWER

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of back scratchers, more specifically, a shower-mounted device that scratches and washes a back.

B. Discussion of the Prior Art

As a preliminary note, it should be stated that there is an ample amount of prior art that deals with back scratchers. As will be discussed immediately below, no prior art discloses a back scratching, scrubbing, and washing device wherein a base attaches to a wall in a shower via a plurality of suction cups; wherein the device has a plurality of interchangeable parts comprising nodules, Loofahs, sponges, bristled nodules, and spring-loaded scrubbers that can be used individually or in combination with one another to perform multiple function simultaneously; wherein the device can scratch, scrub, exfoliate, or wash any part of a body accessible to said device when mounted; and wherein the interchangeable parts attach to the base via a spring pin.

The Lotis Patent (U.S. Pat. No. 4,047,259) discloses a body washing apparatus comprising a flexible rubber-like mat with a plurality of suction cups. However, the mat includes a soap-impregnated sponge surface and does not include a plurality of interchangeable parts used to provide a plurality of bodily engaging uses comprising scrubbing, scouring, washing, and scratching.

The Zamir Patent (U.S. Pat. No. 5,175,896) discloses a bathroom accessory including a base member with suction cups for mounting to a wall and a plurality of projectiosn for massaging the back of an end user. However, the accessory does not teach a mat that attaches to a flat surface and of which features a plurality of interchangeable parts that can work in concert or individually to provide different skin engaging qualities.

The Smith Patent (U.S. Pat. No. 6,647,564) discloses a wall-mountable back scrubber with suction cups. However, the back scrubber does not feature a base having an array of holes that can mount a plurality of interchangeable parts therein to provide a multitude of skin engaging services in addition to a simple scratcher.

The Gurrola Patent (U.S. Pat. No. 3,612,044) discloses a back massage and scrub fixture attached to a shower wall via suction cups. However, the fixture only features friction fingers adapted to fit the human back.

The Kenner Patent (U.S. Pat. No. 4,696,068) discloses a shower wall mounted back scrubber with a plurality of suction cups. Again, the back scrubber is only configured for use with a fabric cover that may include soap to engage skin thereon and does not feature a multitude of uniquely different parts that can be interchanged upon a base to provide different scrubbing, scratching, or cleaning qualities.

The Mejia, Sr. Patent (U.S. Pat. No. Des. 400,658) illustrates a design for a shower back scrubber, which does not depict a plurality of interchangeable parts.

While the above-described devices fulfill their respective and particular objects and requirements, they do not describe a back scratching, scrubbing, and washing device wherein a base attaches to a wall in a shower via a plurality of suction cups; wherein the device has a plurality of interchangeable parts comprising nodules, Loofahs, sponges, bristled brushes, and spring-loaded scrubbers that can be used individually or in combination with one another to perform multiple function simultaneously; wherein the device can scratch, scrub, exfoliate, or wash any part of a body accessible to said device when mounted; and wherein the interchangeable parts attach to the base via a spring pin. In this regard, the back-scratching and washing device for use in a shower departs from the conventional concepts and designs of the prior art.

SUMMARY OF THE INVENTION

The back-scratching and washing device for use in a shower includes a base that attaches to a smooth surface for use within a shower and features a plurality of interchangeable parts that attach to the base to perform a plurality of uniquely different skin engaging services. The interchangeable parts comprise rubber nodules, Loofahs, spring-loaded scrubbers, and bristled nodules. All of the interchangeable parts attach to the base via a spring pin located on a back of said part that engages one of an array of holes located on a front of said base. The device can be used to engage any part of a body, but is chiefly used for the back and hard to reach areas of said body. An array of suction cups located on a back of the base ensure secure attachment of the device to a smooth surface during engagement by an end user.

It is an object of the invention to provide a device that mounts to any surface, and ideally for use in a shower, that provides skin engaging services.

A further object of the invention is to provide skin engaging services comprising scratching, scouring, scrubbing, exfoliating, and washing.

A further object of the invention is to provide a base from which a plurality of interchangeable parts attach to a front surface of the base and of which each perform a specific skin engaging service such that different configurations of the interchangeable parts will yield different skin engaging characteristics that are customizable to the needs of an end user.

A further object of the invention is to provide an array of suction cups along a rear surface of said base that will provide ample securement of the device to a wall in a wet environment such that the device will not become disengaged when forcibly encountered by a body part of an end user.

These together with additional objects, features and advantages of the back-scratching and washing device for use in a shower will be readily apparent to those of ordinary skill in the art upon reading the following detailed description of presently preferred, but nonetheless illustrative, embodiments of the back-scratching and washing device for use in a shower when taken in conjunction with the accompanying drawings.

In this respect, before explaining the current embodiments of the back-scratching and washing device for use in a shower in detail, it is to be understood that the back-scratching and washing device for use in a shower is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the back-scratching and washing device for use in a shower.

It is therefore important that the claims be regarded as including such equivalent construction insofar, as they do not depart from the spirit and scope of the back-scratching and washing device for use in a shower. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
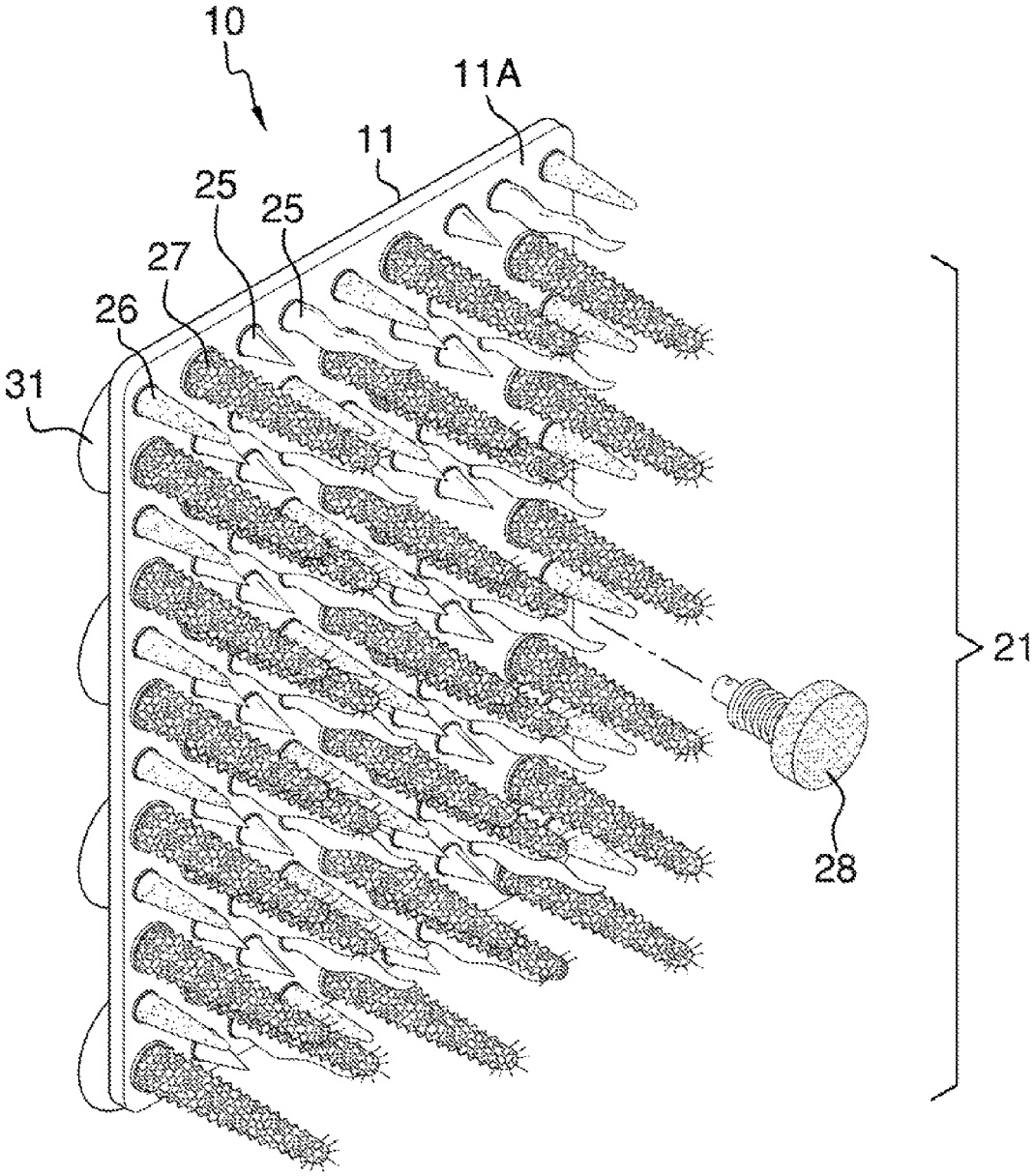
FIG. 1 illustrates a front, isometric view of the back-scratching and washing device for use in a shower by itself and wherein one of the spring-loaded scrubbers is detached from the base and separated therefrom.
Figure 2:
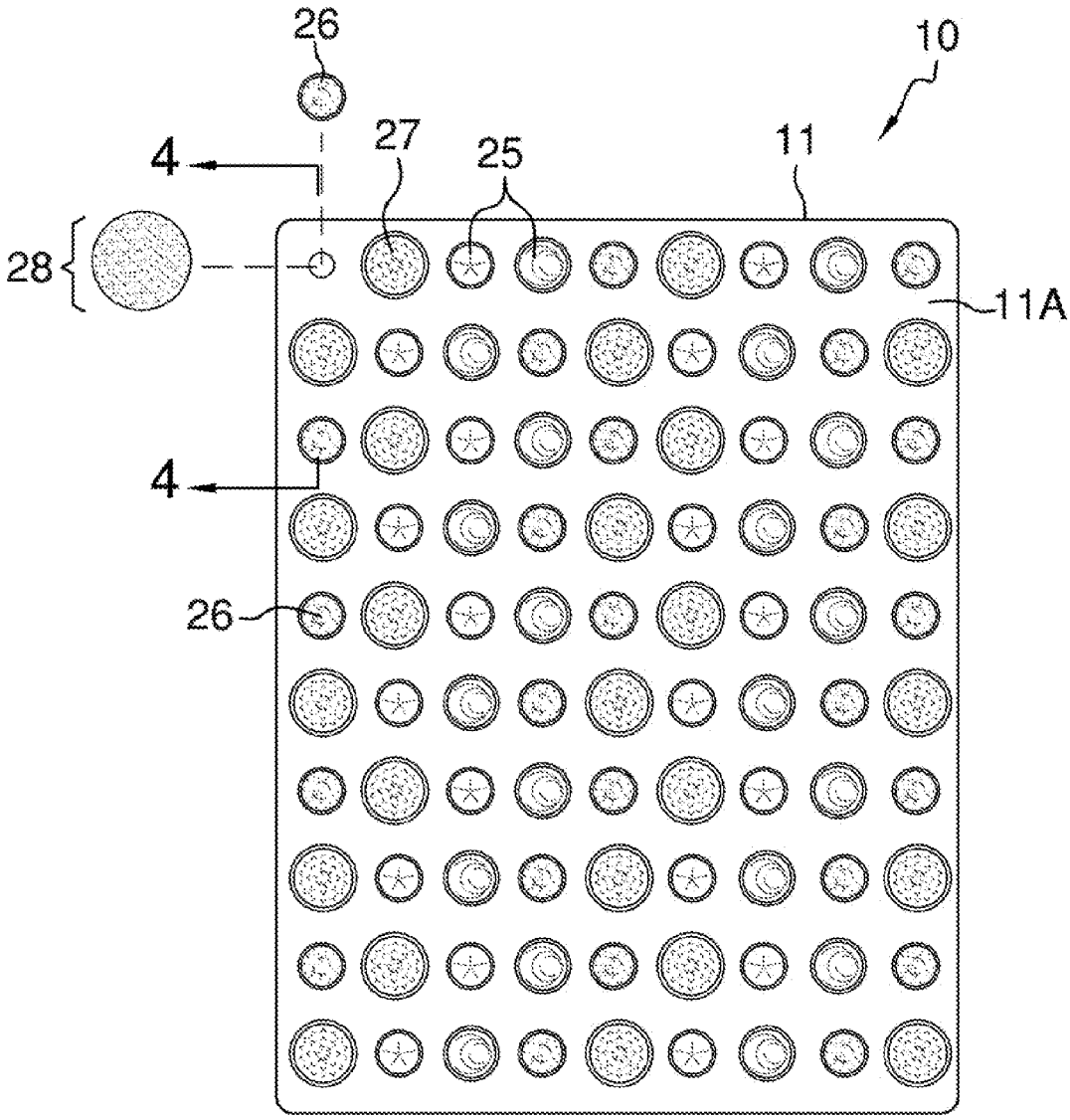
FIG. 2 illustrates a front view of the back-scratching and washing device for use in a shower and detailing the array of interchangeable parts attached to the base and with the top, left position on the base empty and detailing an adjacent Loofah sponge and spring-loaded scrubber.
Figure 3:
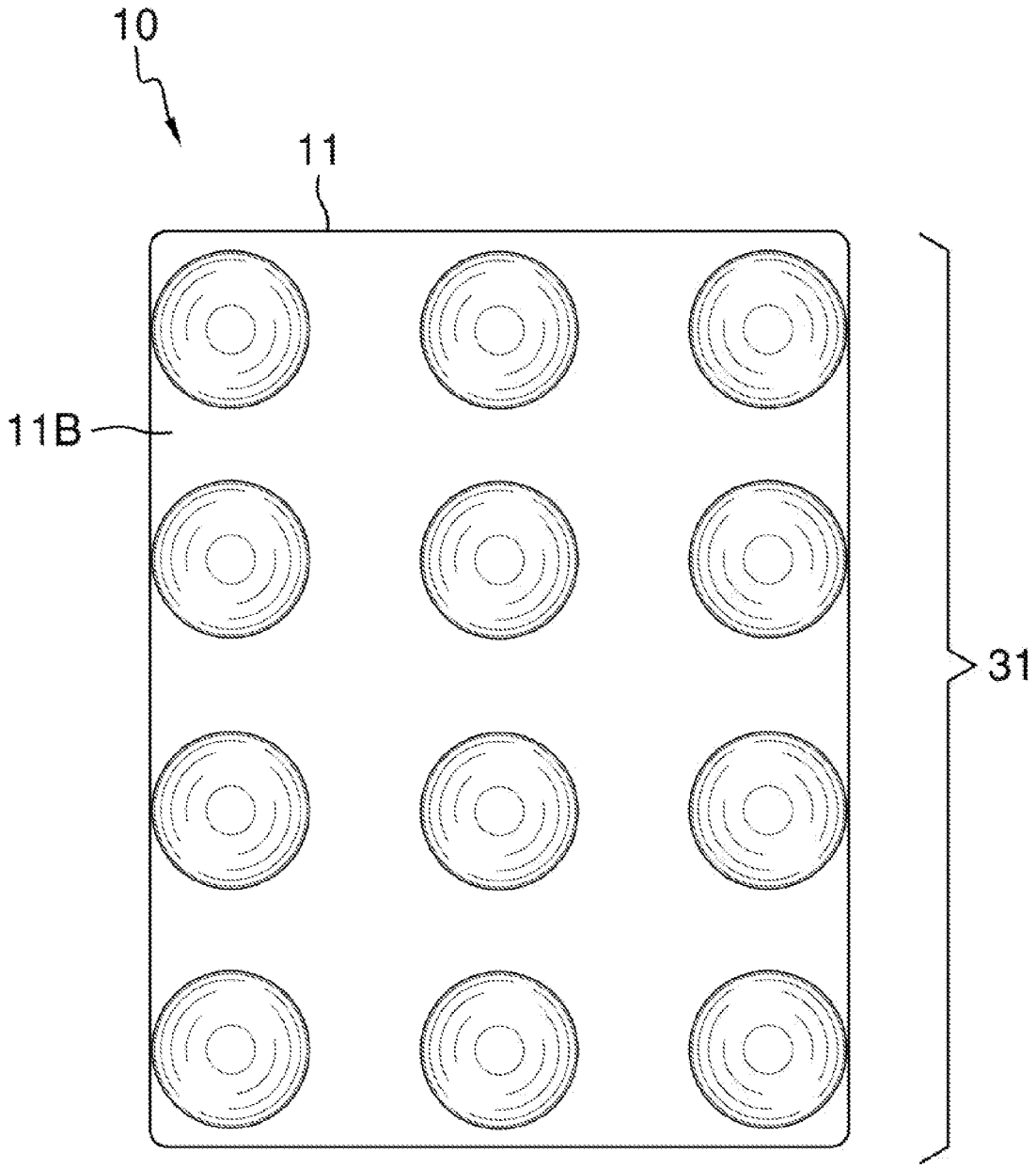
FIG. 3 illustrates a rear view of the back-scratching and washing device for use in a shower and detailing the array of suction cups used to secure the device to a smooth surface.
Figure 4:
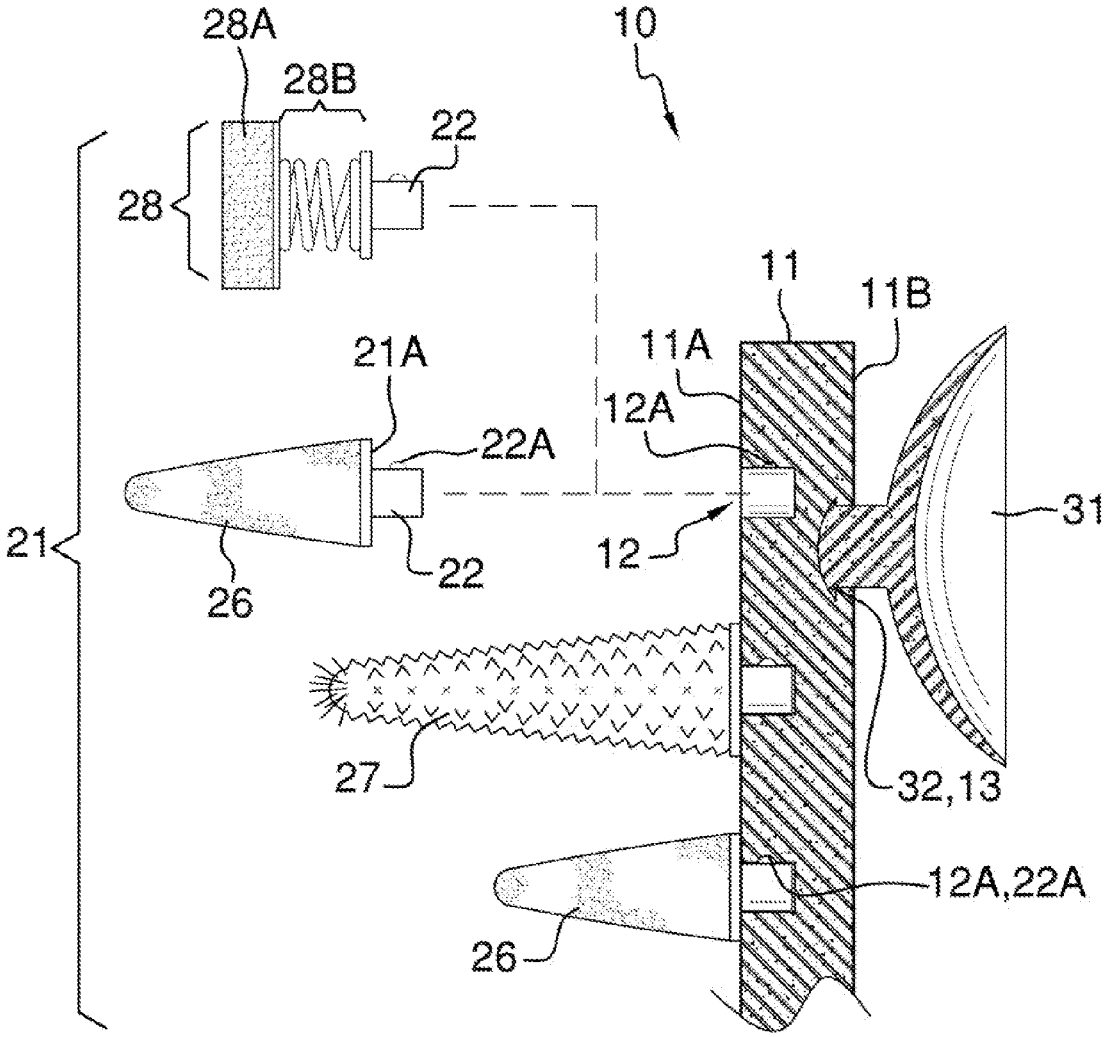
FIG. 4 illustrates a cross-sectional view of the back-scratching and washing device for use in a shower along line 4-4 in FIG. 2 and detailing the connection between the base and the suction cup as well as detailing the connection of the spring pin of the interchangeable parts and the base.
Figure 5:
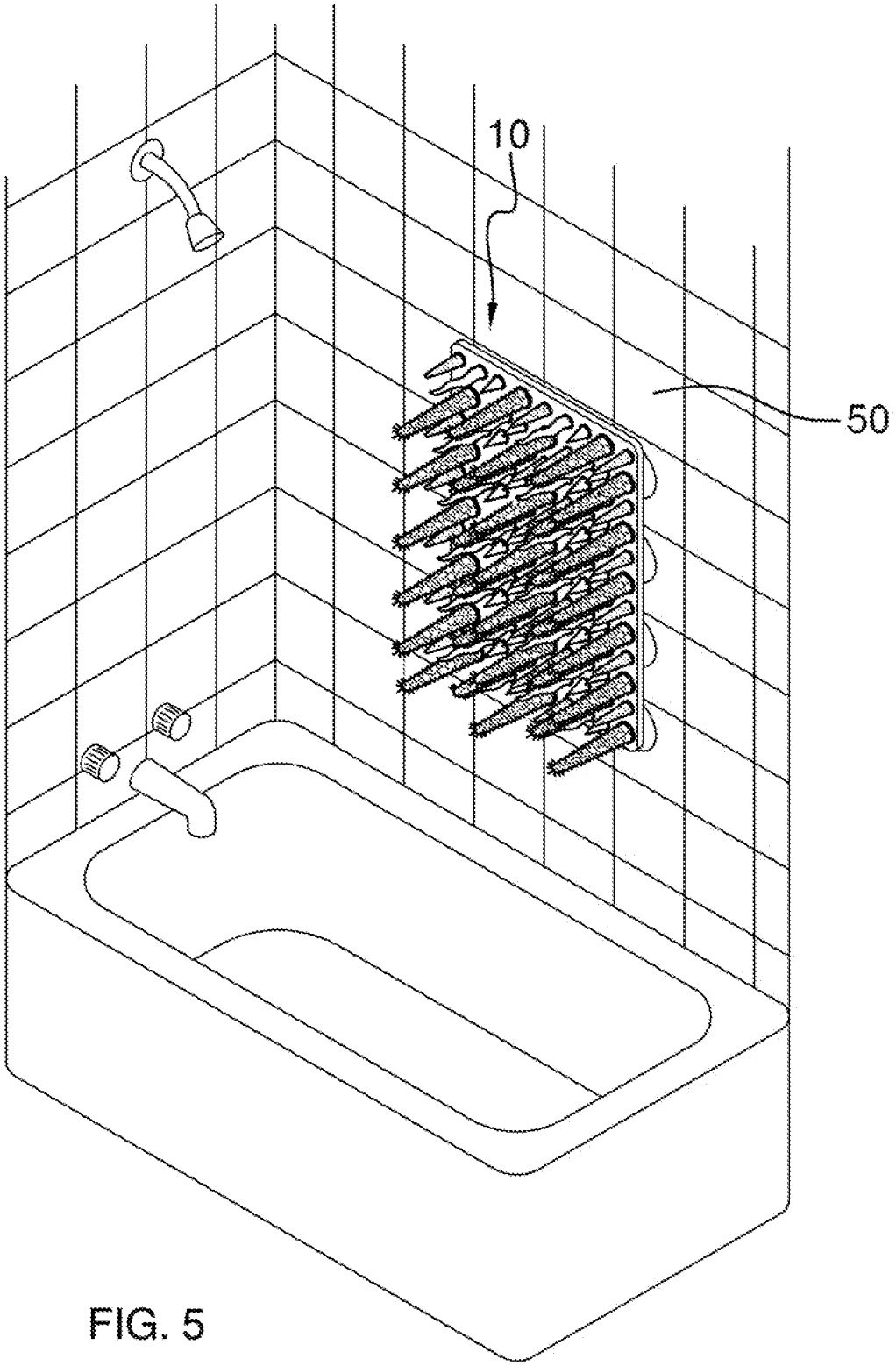
FIG. 5 illustrates an isometric view of the back-scratching and washing device for use in a shower attached to a tile shower wall.

Detailed reference will now be made to the preferred embodiment of the present invention, examples of which are illustrated in FIGS. 1-5. A back-scratching and washing device for use in a shower 10 (hereinafter invention) includes a base 11, interchangeable parts 21, and securing means 31.

The base 11 is made of a material comprising a plastic, rubber, carbon fiber composite, wood, or metal. The base has a front surface 11A upon which the interchangeable parts 21 engage thereon, and will be further discussed below. The base 11 has a rear surface 11B upon which the securing means 31 engage thereon, and will be further discussed below.

Located on the front surface 11A of the base 11 is an array of holes 12. Each hole 12 is suited for supporting a single interchangeable part 21. Each hole 12 has a notch 12A, which interacts with the interchangeable part 21. Located on a rear side 21A of each interchangeable part 21 is a spring pin 22 that fits into one of the holes 12 to secure the interchangeable part 21 to the base 11. The spring pin 22 has a nub 22A that engages the notch 12A to secure the interchangeable part 21 to the base 11. The nub 22A is spring-loaded and is well known in the art.

The interchangeable parts 21 come in a plurality of different skin engaging services and comprise a rubber nodule 25 of varying length and shapes, a Loofah 26, a bristled nodule 27, and spring-loaded scrubbers 28. Each type of interchangeable part 21 performs a unique skin engaging service such that the rubber nodule 25 performs a massaging effect. The different sized and shaped rubber nodules 25 perform unique massaging effects with respect to one another. The Loofah 26 is ideal for use in exfoliating and scouring skin in order to scratch, scrub, and remove dead skin. Additionally, soap can be added onto or impregnated therein in order to provide a washing quality to the Loofah 26.

The bristled nodule 27 performs a similar function as the Loofah 26, but has a different size, shape, and materials. The bristled nodule 27 may be composed of foam or nylon bristles that perform different scratching and scrubbing characteristics when compared to the Loofah 26. Additionally, soap can be added onto or impregnated therein in order to provide a washing quality to the bristled nodule 27.

The spring-loaded scrubber 28 has a sand-paper like surface 28A that extends from a spring 28B, which is in turn attached to the respective spring pin 22. The spring-loaded scrubber 28 has the sandpaper like surface 28A to perform scratching and scouring skin engaging services. The spring 28B enables the spring-loaded scrubber 28 to rotate with respect to the base 11.

The suction cups 31 each include a plug 32 that engages one of a plurality of holes 13 located on the back surface 11B of the base 11. The holes 13 ensure that the suction cups 31 are secured to the base 11; and that the invention 10 is secured to a wall 50. It shall be noted that the wall 50 needs to be smooth in order to effectively secure the invention 10 thereon.

With respect to the above description, it is to be realized that the optimum dimensional relationship for the various components of the invention 10, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 10.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

The inventor claims:

1. A back-scratching device comprising:

a base upon which a plurality of interchangeable parts attach;

wherein an array of suction cups are secured to a back surface of said base in order to secure the back-scratching device to a smooth surface;

wherein the interchangeable parts include a plurality of different skin engaging services;

wherein the interchangeable parts include a spring pin on a rear side of each interchangeable part that engages onto one of a plurality of holes located on a front surface of the base;

wherein the holes each include a notch that is engaged upon by a nub located on the spring pin, which secures the interchangeable part to the base;

wherein the skin engaging services comprise exfoliating, scrubbing, massaging, scouring, and washing;

wherein the interchangeable parts comprise Loofahs, rubber nodules, bristled nodules, and spring-loaded scrubbers;

wherein the spring-loaded scrubbers feature a sandpaper surface that is mounted upon a spring, which can rotate with respect to the base;

wherein the rubber nodules have different sizes and shapes.

2. The back-scratching device as described in claim 1 wherein the bristled nodules are made of nylon or foam bristles.

3. The back-scratching device as described in claim 1 wherein the interchangeable parts attach to the base in different arrangements in order to customize the overall impact of the device or to localize different skin engaging surfaces with respect to the base.

4. The back-scratching device as described in claim 1 wherein the base is made of a material comprising a wood, plastic, metal, rubber, or carbon fiber composite.

5. A back-scratching device comprising:

a base upon which a plurality of interchangeable parts attach;

wherein the interchangeable parts include a spring pin on a rear side of each interchangeable part that engages onto one of a plurality of holes located on a front surface of the base;

wherein the holes each include a notch that is engaged upon by a nub located on the spring pin, which secures the interchangeable part to the base;

wherein an array of suction cups are secured to a back surface of said base in order to secure the back-scratching device to a smooth surface;

wherein the interchangeable parts include a plurality of different skin engaging services comprising exfoliating, scrubbing, massaging, scouring, and washing;

wherein the interchangeable parts comprise Loofahs, rubber nodules, bristled nodules, and spring-loaded scrubbers;

wherein the spring-loaded scrubbers feature a sandpaper surface that is mounted upon a spring, which can rotate with respect to the base;

wherein the rubber nodules have different sizes and shapes;

wherein the bristled nodules are made of nylon or foam bristles.

6. The back-scratching device as described in claim 5 wherein the interchangeable parts attach to the base in different arrangements in order to customize the overall impact of the device or to localize different skin engaging surfaces with respect to the base.

7. The back-scratching device as described in claim 5 wherein the base is made of a material comprising a wood, plastic, metal, rubber, or carbon fiber composite.

8. A back-scratching device comprising:

a base upon which a plurality of interchangeable parts attach;

wherein the interchangeable parts include a spring pin on a rear side of each interchangeable part that engages onto one of a plurality of holes located on a front surface of the base;

wherein the holes each include a notch that is engaged upon by a nub located on the spring pin, which secures the interchangeable part to the base;

wherein an array of suction cups are secured to a back surface of said base in order to secure the back-scratching device to a smooth surface;

wherein the interchangeable parts include a plurality of different skin engaging services comprising exfoliating, scrubbing, massaging, scouring, and washing;

wherein the interchangeable parts comprise Loofahs, rubber nodules, bristled nodules, and spring-loaded scrubbers;

wherein the interchangeable parts attach to the base in different arrangements in order to customize the overall impact of the device or to localize different skin engaging surfaces with respect to the base;

wherein the spring-loaded scrubbers feature a sandpaper surface that is mounted upon a spring, which can rotate with respect to the base; wherein the rubber nodules have different sizes and shapes; wherein the bristled nodules are made of nylon or foam bristles.

9. The back-scratching device as described in claim 8 wherein the base is made of a material comprising a wood, plastic, metal, rubber, or carbon fiber composite.

* * * * *